US010337090B2

(12) United States Patent
Zhu et al.

(10) Patent No.: US 10,337,090 B2
(45) Date of Patent: Jul. 2, 2019

(54) METHOD FOR THE PRODUCTION OF VERY HIGH STRENGTH MARTENSITIC STEEL AND SHEET OR PART THUS OBTAINED

(75) Inventors: Kangying Zhu, Metz (FR); Olivier Bouaziz, Metz (FR)

(73) Assignee: ARCELORMITTAL INVESTIGACIÒN Y DESARROLLO, S.L., Sestao Bizkaia (ES)

( * ) Notice: Subject to any disclaimer, the term of this patent is extended or adjusted under 35 U.S.C. 154(b) by 1143 days.

(21) Appl. No.: 14/116,991

(22) PCT Filed: Apr. 20, 2012

(86) PCT No.: PCT/FR2012/000153
§ 371 (c)(1),
(2), (4) Date: Nov. 11, 2013

(87) PCT Pub. No.: WO2012/153012
PCT Pub. Date: Nov. 15, 2012

(65) Prior Publication Data

US 2014/0076470 A1 Mar. 20, 2014

(30) Foreign Application Priority Data

May 12, 2011 (WO) ..... PCT/FR2011/000294

(51) Int. Cl.
*C22C 38/38* (2006.01)
*C21D 1/19* (2006.01)
(Continued)

(52) U.S. Cl.
CPC ..... *C22C 38/38* (2013.01); *C21D 1/19* (2013.01); *C21D 1/673* (2013.01); *C21D 7/13* (2013.01);
(Continued)

(58) Field of Classification Search
CPC .. C21D 8/0205; C21D 8/0206; C21D 8/0226; C21D 8/0263
See application file for complete search history.

(56) References Cited

U.S. PATENT DOCUMENTS 3,276,903 A * 10/1966 Galmiche ..... 427/253
3,907,614 A 9/1975 Bramfitt
(Continued)

FOREIGN PATENT DOCUMENTS

CN 101111620 A 1/2008
EP 097 1044 A1 1/2000
(Continued)

OTHER PUBLICATIONS

Morito S et al., "Effect of Austenite Grain Size on the Morphology and Crystallography of Lath Martensite in Low Carbon Steels", ISIJ International, Jan. 1, 2005, pp. 91-94, vol. 45, No. 1, Elsevier, Lausanne, CH.
(Continued)

*Primary Examiner* — Anita Nassiri-Motlagh
(74) *Attorney, Agent, or Firm* — Davidson, Davidson & Kappel, LLC

(57) ABSTRACT

The present invention provides a method for the fabrication of a steel sheet with a completely martensitic structure which has an average lath size of less than 1 micrometer and an average elongation factor of the laths is between 2 and 5. The elongation factor of a lath is defined as a maximum dimension $1_{max}$ divided by and a minimum dimension $1_{max}$. The steel sheet has a yield stress greater than 1300 MPa and a mechanical strength greater than (3220(C)+958) megapascals. A composition of a semi-finished steel product includes, expressed in percent by weight, is, 0.15%≤C≤0.40%, 1.5%≤Mn≤3%, 0.005%≤Si≤2%, 0.005%≤Al≤0.1%, 1.8%≤Cr≤4%, 0%≤Mo≤2%, whereby: 2.7%≤0.5 (Mn)+(Cr)+3(Mo)≤5.7%, S≤0.05%, P≤0.1%,
(Continued)

optionally: 0%≤Nb≤0.050%, 0.01%≤Ti≤0.1%, 0.0005%≤B≤0.005%, 0.0005%≤Ca≤0.005%. The semi-finished product is reheated to a temperature $T_1$ in the range between 1050° C. and 1250° C., then subjected to a roughing rolling at a temperature $T_2$ in the range between 1000 and 880° C., with a cumulative rate of reduction $\varepsilon_a$ greater than 30%, to obtain a sheet with a completely recrystallized austenitic structure with an average grain size less than 40 micrometers and preferably less than 5 micrometers. The sheet is then partially cooled to prevent a transformation of the austenite at a rate $V_{R1}$ greater than 2° C./s to a temperature $T_3$ between 600° C. and 400° C. in the metastable austenitic range, and subjected to a finishing hot rolling at the temperature $T_3$ of the partially cooled sheet, with a cumulative rate of reduction $\varepsilon_b$ greater than 30% to obtain a sheet that is then cooled at a rate $V_{R2}$ which is greater than the critical martensitic quenching rate.

11 Claims, 2 Drawing Sheets

(51) Int. Cl.

| | |
|---|---|
| ***C21D 7/13*** | (2006.01) |
| ***C21D 8/02*** | (2006.01) |
| ***C21D 9/46*** | (2006.01) |
| ***C22C 38/04*** | (2006.01) |
| ***C22C 38/18*** | (2006.01) |
| ***C22C 38/22*** | (2006.01) |
| ***C21D 1/673*** | (2006.01) |
| ***C22C 38/02*** | (2006.01) |
| ***C22C 38/06*** | (2006.01) |
| ***C22C 38/34*** | (2006.01) |

(52) U.S. Cl.
CPC ..... *C21D 8/0226* (2013.01); *C21D 8/0231* (2013.01); *C21D 8/0263* (2013.01); *C21D 9/46* (2013.01); *C22C 38/02* (2013.01); *C22C 38/04* (2013.01); *C22C 38/06* (2013.01); *C22C 38/18* (2013.01); *C22C 38/22* (2013.01); *C22C 38/34* (2013.01); *C21D 2211/008* (2013.01)

(56) References Cited

U.S. PATENT DOCUMENTS

| | | | | |
|---|---|---|---|---|
| 6,248,181 | B1 | 6/2001 | Luton et al. | |
| 6,273,968 | B1 | 8/2001 | Thomas | |
| 6,296,805 | B1 | 10/2001 | Laurent et al. | |
| 7,699,947 | B2 | 4/2010 | Seux et al. | |
| 2008/0017283 | A1 | 1/2008 | Maruta | |
| 2010/0230016 | A1 | 9/2010 | Kumagai | |
| 2011/0253271 | A1 * | 10/2011 | Kumagai et al. | 148/645 |

FOREIGN PATENT DOCUMENTS

| | | | | |
|---|---|---|---|---|
| GB | 1080304 | | 8/1967 | |
| GB | 1166042 | | 10/1969 | |
| JP | 61195958 | * | 8/1986 | |
| JP | 9-310116 | | 12/1997 | |
| JP | 11-100644 | | 4/1999 | |
| JP | 2004-337923 | | 12/2004 | |
| JP | 2005-205477 | | 8/2005 | |
| JP | 2007-162076 | | 6/2007 | |
| JP | 2007-275937 | | 10/2007 | |
| KR | 100797326 | * | 1/2008 | |
| RU | 2210603 | C2 | 8/2003 | |
| RU | 2232196 | C2 | 7/2004 | |
| RU | 2333284 | C2 | 9/2008 | |
| RU | 2350662 | C1 | 3/2009 | |
| WO | WO 2010055609 | A1 * | 5/2010 | C22C 38/02 |

OTHER PUBLICATIONS

Morito S et al., "Effect of Block Size on the Strength of Lath Martensite in Low Carbon Steels", Materials Science and Engineering: Structural Materials: Properties, Microstructure & Processing, Nov. 25, 2006, pp. 237-240, vol. 438-440, Elsevier, Lausanne, CH.
Tsuji N et al., "Enhanced Structural Refinement by Combining Phase Transformation and Plastic Deformation in Steels", Scripta Materialia, Jun. 1, 2009, pp. 1044-1049, vol. 60, No. 12, Elsevier, Amsterdam, NL.
Venkataraman G et al., "Thermomechanical Treatment of a Low Carbon Cr—Ni—Mo Steel" Materials Science Engineering, Oct. 1, 1974, pp. 133-141, vol. 16, No. 1-2, Elsevier Sequioa, Lausanne, CH.

* cited by examiner

20 μm

20μm

10 μm

METHOD FOR THE PRODUCTION OF VERY HIGH STRENGTH MARTENSITIC STEEL AND SHEET OR PART THUS OBTAINED

This invention relates to a method for the fabrication of steel sheet or parts with a martensitic structure with mechanical strength greater than that which could be obtained by austenitization followed by a simple rapid cooling treatment with martensitic quenching. The steel sheet or part also includes mechanical strength and elongation properties that make the sheet or part suitable for use in the fabrication of energy-absorbing parts in automotive vehicles.

BACKGROUND

In certain applications, steel parts are manufactured that combine high mechanical strength, high impact strength and good corrosion resistance. This type of combination is particularly desirable in the automobile industry, where attempts are being made to significantly reduce the weight of the vehicles. This weight reduction can be achieved with the use of steel parts with very high mechanical characteristics and a martensitic or bainitic-martensitic microstructure. Anti-intrusion and structural parts, as well as other parts that contribute to the safety of automotive vehicles such as: bumpers, door or center pillar reinforcements and wheel arms, for example, require the above mentioned characteristics, for example. The thickness of these parts is preferably less than 3 millimeters.

EP0971044 also describes the fabrication of a steel sheet coated with aluminum or an aluminum alloy, the composition of which includes, expressed in percent by weight: 0.15-0.5% C, 0.5-3% Mn, 0.1-0.5% Si, 0.011% Cr, Ti<0.2%, Al<0.1%, P<0.1%, S<0.05%, 0.0005%<B<0.08%, the remainder being iron and the inevitable impurities resulting from processing. This sheet is heated to achieve an austenitic transformation and then hot stamped to fabricate a part, which is then cooled rapidly to obtain a martensitic or martensite-bainite structure. In this manner, it is possible to achieve a mechanical strength greater than 1500 MPa, for example.

An additional known fabrication method is called "ausforming", in which a steel is completely austenitized and then rapidly cooled to an intermediate temperature, generally around 700-400° C., a range in which the austenite is metastable. This austenite is hot-shaped and then rapidly cooled to obtain a totally martensitic structure. Patent GB 1,080,304 also describes the composition of a steel sheet intended to be used with a method of the type described above which contains 0.15-1% C, 0.25-3% Mn, 1-2.5% Si, 0.5-3% Mo, 1-3% Cu, 0.2-1% V.

GB 1,166,042 likewise describes a steel composition suitable for this ausforming process which contains 0.1-0.6% C, 0.25-5% Mn, 0.5-2% Al, 0.5-3% Mo, 0.01-2% Si, 0.01-1% V.

These steels include significant additions of molybdenum, manganese, aluminum, silicon and/or copper. The purpose of these elements is to create a wider range of metastability for the austenite, i.e. to retard the beginning of the transformation of the austenite into ferrite, bainite or pearlite, at the temperature at which the hot-shaping is carried out. The majority of these studies devoted to ausforming were performed on steels that have a carbon content greater than 0.3%. Therefore, these compositions that are suitable for ausforming have the disadvantage that particular precautions must be taken for welding, and they also present particular problems if a hot-dip coating is to be applied. These compositions also include expensive alloy elements.

SUMMARY OF THE INVENTION

An object of the present invention is to obtain parts that have even greater mechanical strength. A further objective, at a given level of mechanical strength, is to reduce the carbon content of the steel to improve its weldability.

It is therefore desirable to have a method for the fabrication of steel sheet or parts that does not have the disadvantages mentioned above so that the steel sheet has an ultimate strength that is greater by more than 50 MPa than the strength that could be obtained by means of austenitization followed by a simple martensitic quenching of the steel in question. The inventors have shown that, for carbon contents ranging from 0.15 to 0.40% by weight, the ultimate tensile strength Rm of steel sheets fabricated by total austenitization followed by a simple martensitic quenching depends practically only on the carbon content and is linked to the carbon content with a very high degree of precision, as described in expression (1): Rm (megapascals)=3220(C)+908.

In this expression, (C) designates the carbon content of the steel expressed in percent by weight. At a given carbon content C of a steel, the goal is therefore to have a fabrication method that makes it possible to obtain an ultimate strength greater than 50 MPa in expression (1), i.e. a strength greater than 3220(C)+958 Mpa for this steel. An objective is to have a method that makes possible the fabrication of steel sheet with a very high yield stress, i.e. greater than 1300 MPa. Another objective is to have a method that makes it possible to fabricate steel sheet that can be used immediately, i.e. without the necessity for a tempering treatment after quenching. A further objective is to have a fabrication method that makes possible the fabrication of a sheet or part that can be easily hot-dip coated in a bath of molten metal.

The steel sheet or parts must be weldable using conventional welding methods and preferably not require the addition of expensive alloy elements.

An object of the present invention is to resolve the problems cited above. A preferred object of the present invention is to make available steel sheet with a yield stress greater than 1300 MPa, mechanical tensile strength, expressed in megapascals, greater than (3220)(C)+958 MPa and preferably a total elongation greater than 3%.

To this end, the present invention provides a method for the fabrication of steel sheet with a totally martensitic structure with an average lath size of less than 1 micrometer, whereby the average elongation factor of the laths is between 2 and 5, whereby the elongation factor of a lath having a maximum dimension $1_{max}$ and a minimum dimension $1_{min}$ is defined by $$\frac{l\max}{l\min},$$

with a yield stress greater than 1300 MPa, mechanical strength greater than (3220)(C)+958 megapascals, and (C) designates the carbon content of the steel in percent by weight, including the steps listed below, in the order in which they are listed:

semi-finished steel is provided with the following composition, whereby the contents are expressed in percent by weight: 0.15%≤C≤0.40%, 1.5%≤Mn≤3%, 0.005%≤

Si≤2%, 0.005%≤Al≤0.1%, 1.8%≤Cr≤4%, 0%≤Mo≤2%, whereby 2.7%≤0.5 (Mn)+(Cr)+3(Mo)≤5.7%, S≤0.05%, P≤0.1%, and optionally: 0%≤Nb≤0.050%, 0.01%≤Ti≤0.0005%≤B≤0.005%, 0.0005%≤Ca≤0.005%, the remainder of the composition consisting of iron and the inevitable impurities resulting from processing, the semi-finished product is heated to a temperature $T_1$ between 1050° C. and 1250° C., then the heated semi-finished product is subjected to a roughing rolling at a temperature $T_2$ between 1000 and 880° C., with a cumulative rate of reduction $\varepsilon_a$ greater than 30% to obtain a sheet with a completely recrystallized austenitic grain structure with an average grain size less than 40 micrometers and preferably less than 5 micrometers, whereby the cumulative rate of reduction $\varepsilon_a$ is defined by:

$$\mathrm{Ln}\frac{e_{ia}}{e_{fa}},.$$

where $e_{ia}$ designates the thickness of the semi-finished product before hot roughing rolling and $e_{fa}$ the thickness of the sheet after the roughing rolling, then the sheet is incompletely cooled to a temperature $T_3$ between 600° C. and 400° C. in the metastable austenitic range at a rate $V_{R1}$ which is greater than 2° C./s, then the incompletely cooled sheet is subjected to a hot finish rolling at the temperature $T_3$, with a cumulative rate of reduction $\varepsilon_b$ greater than 30% to obtain a sheet, whereby the cumulative rate of reduction $\varepsilon_b$ is defined by:

$$\mathrm{Ln}\frac{e_{ib}}{e_{fb}},.$$

where $e_{ib}$ designates the thickness of the semi-finished product before hot finish rolling and $e_{fa}$ the thickness of the sheet after the finish rolling, then the sheet is cooled at a rate $V_{R2}$ which is greater than the critical martensitic quenching rate.

The present invention provides another method for the fabrication of a steel part with a totally martensitic structure with an average lath size of less than 1 micrometer, whereby the average elongation factor of the laths is between 2 and 5, including the steps listed below in the order listed below, in which:

a steel blank is provided, the composition of which includes, whereby the contents are expressed in percent by weight: 0.15%≤C≤0.40%, 1.5%≤Mn≤3%, 0.005%≤Si≤2%, 0.005%≤Al≤0.1%, 1.8%≤Cr≤4%, 0%≤Mo≤2%, whereby:

2.7%≤0.5 (Mn)+(Cr)+3(Mo)≤5.7%, S≤0.05%, P≤0.1%, optionally: 0%≤Nb≤0.050%, 0.01%≤Ti≤0.1%, 0.0005%≤B≤0.005%, 0.0005%≤Ca≤0.005%, the remainder of the composition consisting of iron and the inevitable impurities resulting from processing, the blank is heated to a temperature $T_1$ in the range between $A_{C3}$ and $A_{C3}$+250° C. so that the average austenitic grain size is less than 40 micrometers and preferably less than 5 micrometers, then the heated blank is transferred to a hot stamping press or a hot forming device, then the blank is cooled to a temperature $T_3$ in the range between 600° C. and 400° C. at a rate $V_{R1}$ which is greater than 2° C./s to prevent a transformation of the austenite, whereby the order of the last two steps described above can be reversed, then the cooled blank is hot-stamped or hot formed at the temperature $T_3$ by a quantity $\overline{\varepsilon_c}$ greater than 30% in at least one zone, to obtain a part, $\overline{\varepsilon_c}$ being defined by $$\overline{\varepsilon_c} = \frac{2}{\sqrt{3}}\sqrt{(\varepsilon_1^2 + \varepsilon_1\varepsilon_2 + \varepsilon_2^2)},$$

where $\varepsilon_1$ and $\varepsilon_2$ are the cumulative principal deformations over all of the deformation steps at the temperature $T_3$, then, the sheet is cooled at a rate $V_{R2}$ which is greater than the critical martensitic quenching rate.

In a preferred embodiment, the blank is hot-stamped to obtain a part, then the part is held in the stamping tool so that it cools at a rate $V_{R2}$ which is greater than the critical martensitic tempering rate.

In a preferred embodiment, the blank is pre-coated with aluminum or an aluminum-based alloy.

In another preferred embodiment, the blank is pre-coated with zinc or a zinc-based alloy.

Preferably, the steel sheet or part obtained by any one of the fabrication methods described above is subjected to a subsequent tempering heat treatment at a temperature $T_4$ between 150 and 600° C. for a period of time between 5 and 30 minutes.

The present invention provides an untempered steel sheet with a yield stress greater than 1300 MPa, mechanical strength greater than (3220(C)+958) megapascals, whereby (C) designates the carbon content of the steel in percent by weight, obtained by means of any of the fabrication methods described above, with a totally martensitic structure, with an average lath size less than 1 micrometer and whereby the average elongation factor of the laths is between 2 and 5.

The present invention also provides an untempered steel part obtained by any of the part fabrication methods described above, whereby the part has at least one zone with a totally martensitic structure, with an average lath size of less than 1 micrometer, whereby the average elongation factor of the laths is between 2 and 5, the yield stress in said zone is greater than 1300 MPa and the mechanical strength greater than (3220(C)+958) megapascals, and whereby (C) designates the carbon content of the steel in percent by weight.

The present invention further provides a steel sheet or part obtained via the method with the tempering treatment described above, whereby the steel has a totally martensitic structure with, in at least on one zone, an average lath grain size of less than 1.2 micrometers, whereby the average elongation factor of the laths is between 2 and 5.

The inventors have shown that the problems described above can be solved thanks to a specific ausforming method performed on a particular range of steel compositions. In contrast to previous research, which seemed to indicate that ausforming requires the addition of expensive alloy elements, the inventors have shown that, surprisingly, this effect can be obtained thanks to compositions that contain significantly lower amounts of alloy elements.

BRIEF DESCRIPTION OF THE DRAWINGS

Additional characteristics and advantages of the present invention will be made clear in the following description, which is provided by way of example, and refers to the accompanying figures, in which.

DETAILED DESCRIPTION

Figure 1:
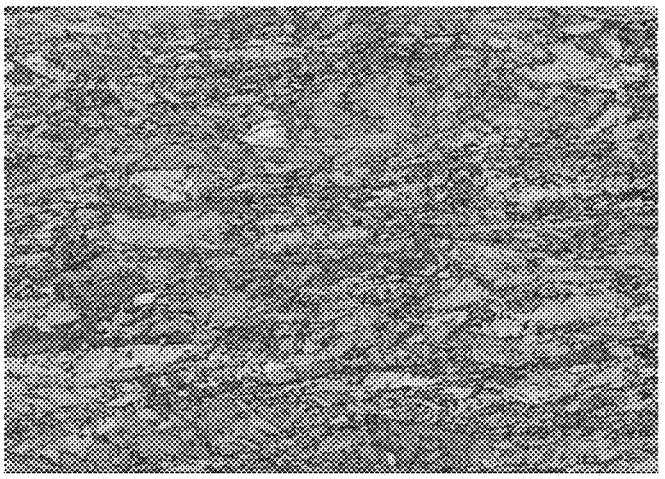
FIG. 1 shows an example of the microstructure of steel sheet fabricated by a method of the present invention.

The composition of the steels used in the method claimed by the invention is described in greater detail below.

When the carbon content of the steel is less than 0.15% by weight, the hardenability of the steel is insufficient, taking the method used into consideration, and it is not possible to achieve a totally martensitic structure. When this content is greater than 0.40%, the welded joints fabricated from these sheets or these parts exhibit insufficient toughness. The optimum carbon content for the use according to a preferred embodiment of the present invention is between 0.16 and 0.28%.

Manganese lowers the temperature at which the martensite begins to form and slows down the decomposition of the austenite. To achieve satisfactory effects to make the use of ausforming possible, the manganese content must not be less than 1.5%. In addition, when the manganese content exceeds 3%, segregated zones are present in excessive quantities, which has an adverse effect on the performance of a method of the present invention. A preferred range for the performance of the method claimed by the invention is 1.8 to 2.5% Mn.

The silicon content must be greater than 0.005% to contribute to the deoxidation of the steel in the liquid phase. The silicon content must not exceed 2% by weight on account of the formation of surface oxides which significantly reduce the coatability in methods that include the continuous passage of the steel sheet through a metal coating bath.

Chromium and molybdenum are elements that are very effective in retarding the transformation of the austenite and in separating the ferritic-pearlitic and bainitic transformation ranges, whereby the ferritic-pearlitic transformation occurs at higher temperatures than the bainitic transformation. These transformation ranges are reflected in the form of two quite separate "noses" in a TTT (Transformation-Temperature-Time) isothermal transformation diagram starting with austenite, which makes possible the performance of a preferred method of the present invention.

The chromium content of the steel must be between 1.8% and 4% by weight for its effect of slowing down the transformation of the austenite to be sufficient. The chromium content of the steel takes into consideration the content of other elements that increase the hardenability such as manganese and molybdenum; in fact, taking into consideration the respective effects of manganese, chromium and molybdenum on transformations starting with austenite, a combined addition of these elements must be made respecting the following condition, whereby the respective quantities of (Mn), (Cr) and (Mo) noted are expressed in percent by weight: $2.7\% \leq 0.5\,(Mn)+(Cr)+3\,(Mo) \leq 5.7\%$.

However, the molybdenum content must not exceed 2%, on account of its excessive cost.

The aluminum content of the steel in accordance with a preferred embodiment of the present invention is not less than 0.005% so as to achieve a sufficient deoxidation of the steel in the liquid state. Casting problems can occur when the aluminum content is greater than 0.1% by weight. Alumina inclusions can also be formed in excessive quantities or size, which have an undesirable effect on the toughness.

The levels of sulfur and phosphorus in the steel are limited to 0.05 and 0.1% respectively to prevent a reduction of the ductility or the toughness of the parts or of the sheets fabricated according to the present invention.

The steel can optionally contain niobium and/or titanium, which makes possible an additional reduction in the grain size. Notwithstanding the hot hardening properties that these additions confer, they must nevertheless be limited to 0.050% for the niobium and be kept between 0.01 and 0.1% for the titanium, so as not to increase the forces that must be applied during the hot rolling.

Optionally, the steel can also include boron; in effect, the significant deformation of the austenite can accelerate the transformation into ferrite during cooling, a phenomenon which must be prevented. An addition of boron, in a range between 0.0005 and 0.005% by weight, provides a hedge against premature ferrite transformation.

Optionally, the steel can also contain calcium in a quantity between 0.0005 and 0.005%; by combining with oxygen and sulfur, the calcium makes it possible to prevent the formation of large inclusions, which have an undesirable effect on the ductility of the sheets or the parts fabricated from them.

The remainder of the composition of the steel consists of iron and the inevitable impurities resulting from processing.

The steel sheets or parts fabricated in accordance with the present invention are characterized by a totally martensitic structure with very fine laths; on account of the thermomechanical cycle and the specific composition, the average size of the martensitic laths is less than 1 micrometer and their average coefficient of elongation is between 2 and 5. These microstructural characteristics are determined, for example, by observing the microstructure via scanning electron microscopy by means of a field emission gun (the "MEB-FEG" technique) at a magnification greater than 1200×, coupled with an EBSD ("Electron Backscatter Diffraction) detector. Two contiguous laths are defined as separate when their misorientation is greater than 5 degrees. The average size of the laths is defined by the intercepts method, which is in itself known; the average size of the laths intercepted by the lines defined randomly with respect to the microstructure is evaluated. The measurement is taken over at least 1000 martensitic laths to obtain a representative average value. The morphology of the individualized laths is then determined by image analysis using software which is in itself known; the maximum dimension $1_{max}$ and minimum $1_{min}$ dimension of each martensitic lath are determined, as well as its elongation factor $$\frac{l\max}{l\min}.$$

To be statistically representative, this observation must include at least 1000 martensitic laths. The average elongation factor $$\overline{\frac{l\max}{l\min}}$$

is then determined for all of these laths observed.

A method of the present invention can be used to fabricate either rolled sheet or hot-stamped or hot-shaped parts. These two modes are explained in greater detail below.

The method for the fabrication of hot-rolled sheet according to a preferred embodiment of the present invention includes the following steps.

First, a semi-finished steel product having the composition specified above is obtained. This semi-finished product can be in the form of a continuously cast slab, for example, or a thin slab or an ingot. By way of a non-restrictive example, a continuously cast slab has a thickness on the order of 200 mm, and a thin slab has a thickness on the order of 50-80 mm. This semi-finished product is heated to a temperature $T_1$ between 1050° C. and 1250° C. The temperature $T_1$ is higher than $A_{c3}$, the total austenite transformation temperature during heating. This heating therefore makes it possible to obtain a complete austenitization of the steel as well as the dissolution of any niobium carbonitrides that may be present in the semi-finished product. This reheating step also makes it possible to carry out the subsequent hot rolling operations which are described below; the semi-finished product is subjected to a rolling process called roughing rolling at a temperature $T_2$ in the range between 1000 and 880° C.

The cumulative rate of reduction of the different steps of the roughing rolling is designated $\varepsilon_a$. If $e_{ia}$ designates the thickness of the semi-finished product prior to the hot roughing rolling, and $e_{fa}$ the thickness of the sheet after this rolling, the cumulative reduction rate is defined by $$\varepsilon_a = \mathrm{Ln}\frac{e_{ia}}{e_{fa}}.$$

The present invention shows that the cumulative reduction rate $\varepsilon_a$ during the roughing rolling must be greater than 30%. Under these conditions, the austenite obtained is totally recrystallized with an average grain size of less than 40 micrometers, or even less than 5 micrometers when the deformation $\varepsilon_a$ is greater than 200% and when the temperature $T_2$ is in the range between 950 and 880° C. The sheet is then cooled, but not completely, i.e. to an intermediate temperature $T_3$ to prevent a transformation of austenite, at a rate $V_{R1}$ which is greater than 2° C./s, to a temperature $T_3$ which is in the range between 600° C. and 400° C., a temperature range in which the austenite is metastable, i.e. in a range in which it should not be present under conditions of thermodynamic equilibrium. The sheet is then subjected to a hot finish rolling at the temperature $T_3$, whereby the cumulative reduction rate $\varepsilon_b$ is greater than 30%. Under these conditions, a plastically deformed austenitic structure is obtained in which recrystallization does not occur. The sheet is then cooled at a rate $V_{R2}$ which is greater than the critical martensitic quenching rate.

Although the above method describes the fabrication of flat products (sheet) on the basis of slabs in particular, the present invention is not limited to this geometry or to this type of product, and can be used for the fabrication of long products, bars, rods or structural shapes via subsequent hot-forming steps.

The method for the fabrication of hot-stamped or hot-shaped parts follow.

First a steel blank is obtained, the composition by weight of which is as follows: 0.15%≤C≤0.40%, 1.5%≤Mn≤3%, 0.005%≤Si≤2%, 0.005%≤Al≤0.1%, 1.8%≤Cr≤4%, 0%≤Mo≤2%, whereby 2.7%≤0.5 (Mn)+(Cr)+3(Mo)≤5.7%, S≤0.05%, P≤0.1%, and optionally: 0%≤Nb≤0.050%, 0.01%≤Ti≤0.1%, 0.0005%≤B≤0.005%, 0.0005%≤Ca≤0.005%.

This flat blank is obtained by cutting from a sheet or coil in a shape that is appropriate to the final geometry of the intended part. This blank can be non-coated or optionally pre-coated. The pre-coating can be aluminum or an aluminum-based alloy. In the latter case, the sheet can advantageously be obtained by continuous dipping in an aluminum-silicon alloy bath that contains, in percent by weight, 5-11% silicon, 2 to 4% iron, optionally between 15 and 30 ppm calcium, with the rest consisting of aluminum and the inevitable impurities resulting from processing.

The blank can also be pre-coated with zinc or a zinc-based alloy. The pre-coating process can in particular be a type of hot-dip galvanizing ("GI") or galvannealing ("GA").

The blank is heated to a temperature $T_1$ in the range between $A_{c3}$ and $A_{c3}$+250° C. If the blank is pre-coated, the heating is preferably carried out in a furnace under a regular atmosphere; an alloying between the steel and the pre-coating occurs during this step. The coating formed by alloying protects the underlying steel from oxidation and decarburization and is appropriate for subsequent hot-shaping. The blank is held at a temperature $T_1$ to ensure the uniformity of its internal temperature. Depending on the thickness of the blank, which can be in the range between 0.5 and 3 mm, for example, the hold time at the temperature $T_1$ varies from 30 seconds to 5 minutes.

Under these conditions, the structure of the steel in the blank is completely austenitic. The purpose of limiting the temperature to $A_{c3}$+250° C. is to restrict the enlargement of the austenite grain to an average size of less than 40 micrometers. When the temperature is between Ac3 and Ac3+50° C. the average grain size is preferably less than 5 micrometers.

the blank heated in this manner is then transferred to a hot-stamping press or to a hot-forming device; the latter can be a "roll-forming" device, for example, in which the blank is gradually shaped by hot forming in a series of rollers until it reaches the final geometry of the desired part. The blank must be transferred to the press or to the forming device quickly enough so that it does not cause the transformation of the austenite.

the blank is then cooled at a rate $V_{R1}$ which is greater than 2° C./s to prevent the transformation of the austenite to a temperature $T_3$ which is in the range between 600° C. and 400° C., the temperature range in which the austenite is metastable.

In one variant of the present invention, it is also possible to reverse the order of these last two steps, i.e. to first cool the blank at a rate $V_{R1}$ greater than 2° C./s, and then to transfer this blank to the stamping press or a hot-shaping device, so that it can be stamped or hot-shaped as described below.

The blank is hot-stamped or hot-formed at a temperature $T_3$ in the range between 400 and 600° C., whereby this hot forming can be performed in a single step or in a plurality of successive steps, as in the above mentioned case of roll-forming. Starting with an initially flat blank, the stamping makes it possible to obtain a part, the shape of which is not developable. Regardless of the mode of hot forming, the cumulative deformation $\overline{\varepsilon_c}$ must be greater than 30% to obtain a deformed austenite which is not recrystallized. Because the deformation modes can vary from one location to another on account of the geometry of the part and the local stress mode (expansion, shrinkage, uniaxial traction or compression), $\overline{\varepsilon_c}$ is used to designate the equivalent deformation defined at each point of the part by $$\overline{\varepsilon_c} = \frac{2}{\sqrt{3}}\sqrt{(\varepsilon_1^2 + \varepsilon_1\varepsilon_2 + \varepsilon_2^2)},$$

where $\varepsilon_1$ and $\varepsilon_2$ are the principal deformations accumulated over all the deformation steps at the temperature $T_3$. In a preferred variant, the mode of hot shaping is selected so that the condition $\overline{\varepsilon_c}>30\%$ is satisfied at every point on the shaped part.

Optionally, it is also possible to utilize a hot forming method where this condition is satisfied only in certain particular points corresponding to the most highly stressed zones of the parts, where the objective is to achieve particularly high mechanical characteristics. Under these conditions, the result is a part whose mechanical properties are variable, which can have certain points with simple martensitic quenching (case of zones that may not be locally deformed during the hot-shaping), and other zones that are created by the method claimed by the invention, which leads to a martensitic structure with an extremely small lath size and increased mechanical properties.

After hot shaping, the part is cooled at a rate $V_{R2}$ which is greater than the critical martensitic quenching rate to obtain a totally martensitic structure. In the case of hot stamping, this cooling can be achieved by holding the part in the tool or die in close contact with the tool or die. This cooling via thermal conduction can be accelerated by cooling the stamping tool or die, e.g. thanks to channels machined in the tool or die that allow the circulation of a cooling liquid.

Aside from the composition of the steel used, the hot stamping method in accordance with the present invention therefore differs from the conventional method, which consists of beginning the hot stamping as soon as the blank has been positioned in the press. According to the conventional method, the yield stress of the steel is lowest at high temperature and the forces required by the press are the lowest. By comparison, the method of the present invention includes observing a waiting period to allow the blank to reach a temperature range which is suitable for ausforming, and then hot-stamping the blank at a temperature which is significantly lower than in the conventional method. For a given thickness of blank, the stamping force required from the press is slightly higher, although the final structure obtained is finer than in the conventional method, which results in higher mechanical properties of yield stress, strength and ductility. To satisfy a performance specification corresponding to a given stress level, it is therefore possible to reduce the thickness of the blanks, and therefore to reduce the force required to stamp parts of the present invention.

Moreover, in the conventional hot stamping method, the hot shaping immediately after stamping must be limited, because at a high temperature this deformation has a tendency to promote the formation of ferrite in the most highly deformed zones, which it is desirable to prevent. A method in accordance with the present invention does not have this limitation.

Whatever the variant of the method of the present invention, the steel sheets or parts can be used as is or subjected to a thermal tempering treatment performed at a temperature $T_4$ which is in a range between 150 and 600° C. for a period of time between 5 and 30 minutes. This tempering treatment generally increases the ductility at the expense of a reduction in the yield stress and tensile strength. However, the inventors have shown that a method of the present invention, which confers a mechanical tensile strength Rm which is at least 50 MPa higher than that obtained after conventional quenching preserves this advantage, even after a tempering treatment at temperatures ranging from 150 to 600° C. The fineness characteristics of the microstructure are preserved by this tempering treatment, whereby the average size of the laths is less than 1.2 micrometers and the average elongation factor of the laths is between 2 and 5.

The following results, which are presented by way of a non-restrictive example, demonstrate the advantageous characteristics achieved by the invention.

Example 1

Semi-finished steel products are provided containing the elements listed below, expressed in percent (%) by weight:

| Steel | C | Mn | Si | Cr | Mo | Al | S | P | Nb | Ti | B | 0.5Mn + Cr + 3Mo |
|---|---|---|---|---|---|---|---|---|---|---|---|---|
| A | 0.195 | 1.945 | 0.01 | 1.909 | 0.05 | 0.03 | 0.003 | 0.02 | 0.01 | 0.012 | 0.0014 | 3.03 |
| B | 0.24 | 1.99 | 0.01 | 1.86 | 0.008 | 0.027 | 0.003 | 0.02 | 0.008 | — | — | 2.88 |

Semi-finished products 31 mm thick were heated and held for 30 minutes at a temperature $T_1$ of 1050° C., then subjected to a roughing rolling in 5 passes at a temperature $T_2$ of 910° C. to a thickness of 6 mm, i.e. a cumulative reduction rate $\varepsilon_a$ of 164%. At this stage, the structure is totally austenitic and completely recrystallized with an average grain size of 30 micrometers. The sheets thus obtained were then cooled at the rate of 25° C./s to a temperature $T_3$ of 550° C. at which they were rolled in 5 passes with a cumulative reduction rate $\varepsilon_b$ of 60%, then cooled to ambient temperature at a rate of 80° C./s to obtain a completely martensitic microstructure. For purposes of comparison, steel sheet having the composition described above was heated and held for 30 minutes at 1250° C., then cooled by quenching in water to obtain a completely martensitic microstructure (reference treatment).

By means of tensile tests, the yield stress Re, the ultimate strength Rm and the total elongation A of the sheets obtained by these different modes of fabrication was determined. The following table also shows the estimated value of the strength after simple martensitic quenching (3220(C)+908) (MPa) as well as the difference ΔRm between this estimated value and the resistance actually measured.

The microstructure of the sheet obtained was also observed by means of Scanning Electron Microscopy with a field emission gun ("MEB-FEG") technique and an EBSD detector. The average size of the laths of the martensitic structure as well as their average elongation factor $$\frac{\overline{l\max}}{\overline{l\min}}$$

was also quantified.

The results of these different characterizations are presented below. Tests A1 and A2 designate the tests performed on the steel composition A in two different conditions; test B1 was performed on steel composition B.

| | Test | Temperature $T_3$ (° C.) | Re (MPa) | Rm (MPa) | A (%) | 3220% C + 908 (MPa) | ΔRm (MPa) | Average lath size (μm) | $\frac{\overline{lmax}}{\overline{lmin}}$ |
|---|---|---|---|---|---|---|---|---|---|
| Invention | A1 | 550 | 1588 | 1889 | 5.9 | 1536 | 353 | 0.9 | 3 |
| | B1 | 550 | 1572 | 1986 | 6.5 | 1681 | 306 | 0.8 | 4 |
| Reference | A2 | None | 1223 | 1576 | 6.9 | 1536 | 40 | 2 | 7 |

Figure 2:
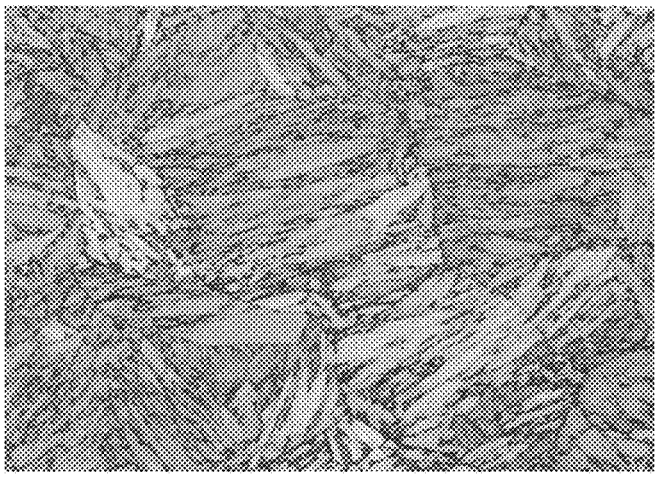
FIG. 2 shows an example of the same steel fabricated by a reference method by heating in the austenite range followed by a simple martensitic quenching.

Test conditions and mechanical results obtained
Underlined values: not in conformance with the invention FIG. 1 illustrates the microstructure obtained in the case of test A1. By comparison, FIG. 2 illustrates the microstructure of the same steel simply heated to 1250° C., held at this temperature for 30 minutes and then quenched in water (test A2). A method of the present invention makes it possible to obtain a martensite with an average lath size which is significantly finer and less elongated than in the reference structure.

In the case of test A2 (simple martensitic quenching), it is observed that the strength value estimated (1536 Mpa) on the basis of expression (1) is close to that determined experimentally (1576 MPa).

In tests A1 and B1 claimed by the invention, the values of ΔRm are respectively 353 and 306 MPa. The method of the present invention therefore makes it possible to obtain mechanical strength values which are significantly higher than those that would be obtained by simple martensitic quenching. This strength increase (353 or 306 MPa) is equivalent to that which would be obtained, according to expression (1), by a simple martensitic quenching applied to steels to which an additional amount of approximately 0.11% or 0.09% had been added. However, an increase of this type in the carbon content would have undesirable consequences in terms of weldability and toughness, although a method of the present invention makes it possible to achieve very high mechanical strength values without these disadvantages.

Sheets fabricated in accordance with the present invention, on account of a lower carbon content, have good suitability for welding using the usual methods, in particular spot resistance welding.

Thermal tempering treatments were then performed under different temperature conditions and for different lengths of time on steel in condition B1 above; for a temperature up to 600° C. and a length of time up to 30 minutes, the average size of the martensitic laths remains less than 1.2 micrometers.

Example 2

Steel blanks with a thickness of 3 mm were obtained with the following composition, expressed in percent by weight (%):

| Steel | C | Mn | Si | Cr | Mo | Al | S | P | Nb | 0.5Mn + Cr + 3Mo |
|---|---|---|---|---|---|---|---|---|---|---|
| B | 0.24 | 1.99 | 0.01 | 1.86 | 0.008 | 0.027 | 0.003 | 0.02 | 0.008 | 2.88 |

The blanks were then subjected to a heating to 1000° C. (i.e. Ac3+210° C. approximately) for 5 minutes. They were then:

either cooled to 50° C./s to the temperature $T_3$ of 525° C. then hot-stamped at this temperature with an equivalent deformation $\overline{\varepsilon_c}$ greater than 50%, and then cooled at a rate greater than the critical martensitic quenching rate (test B2)

or cooled to 50° C./s to the temperature of 525° C., then cooled at a rate greater than the critical martensitic quenching rate (test B3)

The following table presents the mechanical properties obtained:

| | Test | Temperature $T_3$ (° C.) | Re (MPa) | Rm (MPa) | 3220% C + 908 | IΔRmI (MPa) | Average lath size (μm) | $\frac{\overline{lmax}}{\overline{lmin}}$ |
|---|---|---|---|---|---|---|---|---|
| Invention | B2 | 525 | 1531 | 1912 | 1681 | 299 | 0.9 | 3 |
| Reference | B3 | — | 1320 | 1652 | 1681 | 29 | 1.8 | 5 |

Figure 3:
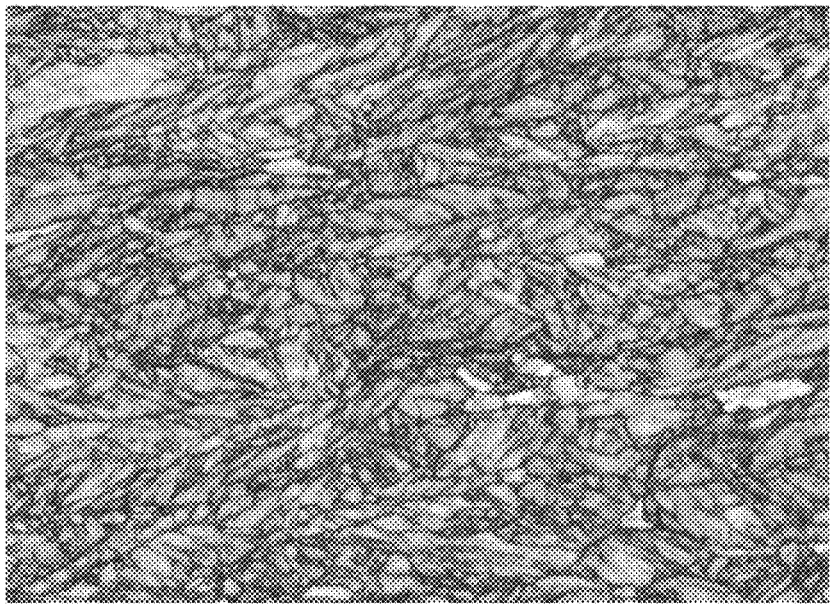
FIG. 3 shows an example of the microstructure of a steel part fabricated by a method of the present invention.

Test conditions and mechanical results obtained
Underlined values: not in conformance with the invention FIG. 3 illustrates the microstructure obtained in condition B2 claimed by the invention, characterized by a very find average lath size (0.9 micrometers) and a low elongation factor.

The invention therefore makes possible the fabrication of bare or coated sheet or parts with very high mechanical characteristics under very satisfactory economic conditions.

These sheets or parts can be advantageously used for the fabrication of safety-relevant parts, and in particular anti-intrusion or underbody parts, reinforcing bars and center pillars for the construction of automotive vehicles.

What is claimed is:

1. A method for fabrication of a steel part with a completely martensitic structure having an average lath size of less than 1 micrometer, an average elongation factor of the laths being between 2 and 5, the elongation factor of a lath with a maximum dimension $1_{max}$ and minimum dimension $1_{mm}$ being defined by $$\frac{l\max}{l\min},$$

the method comprising the following:

obtaining a steel blank, a composition of the steel blank including, whereby the contents are expressed by weight, 0.15%≤C≤0.40%, 1.5%≤Mn≤3%, 0.005%≤Si≤2%, 0.005%≤Al≤0.1%, 1.8%≤Cr≤4%, 0%≤Mo≤2%, whereby 2.7%≤0.5 (Mn)+(Cr)+3(Mo)≤5.7%,

S≤0.05%,

P≤0.1%, a remainder of the composition including iron and inevitable impurities resulting from processing, heating the blank to a temperature $T_1$ in a range between $A_{C3}$ and $A_{C3}$+250° C. so that an average austenitic grain size is less than 40 micrometers;

transferring the heated blank to a hot stamping press or a hot forming device;

cooling the blank to a temperature $T_3$ in a range between 600° C. and 400° C. at a rate $V_{R1}$ which is greater than 2° C./s to prevent a transformation of austenite;

hot stamping or hot forming the cooled blank at the temperature $T_3$ by a quantity $\overline{\varepsilon_c}$ greater than 30% in at least one zone, to obtain a part, $\overline{\varepsilon_c}$ being defined by $$\overline{\varepsilon_c} = \frac{2}{\sqrt{3}}\sqrt{(\varepsilon_1^2 + \varepsilon_1\varepsilon_2 + \varepsilon_2^2)},$$

where $\varepsilon_1$ and $\varepsilon_2$ are principal deformations accumulated over all of the deformation steps at the temperature $T_3$; and cooling the part at a rate $V_{R2}$ which is greater than a critical martensitic quenching rate.

2. The method for the fabrication of a part as recited in claim 1, wherein the blank is hot-stamped to obtain a part, the part is held in a stamping tool to cool the part at a rate $V_{R2}$ which is greater than a critical martensitic quenching rate.

3. The method for the fabrication of a steel part as recited in claim 1, wherein the blank is pre-coated with aluminum or an aluminum-based alloy.

4. The method for the fabrication of a steel part as recited in claim 1, wherein the blank is pre-coated with zinc or a zinc-based alloy.

5. The method for the fabrication of steel part as recited in claim 1, further comprising the step of subjecting the part to a tempering heat treatment at a temperature $T_4$ which is between 150 and 600° C. for a period of time between 5 and 30 minutes.

6. The method for the fabrication of a steel part as recited in claim 1, wherein the average grain size less is less than 5 micrometers.

7. The method for the fabrication of a steel part as recited in claim 1, wherein the transferring step may occur before or after the step of cooling the blank to a temperature T3.

8. The method for the fabrication of a steel part as recited in claim 1, wherein the composition of the steel blank includes 0%≤Nb≤0.050%.

9. The method for the fabrication of a steel part as recited in claim 1, wherein the composition of the steel blank includes 0.01%≤Ti≤0.1%.

10. The method for the fabrication of a steel part as recited in claim 1, wherein the composition of the steel blank includes 0.0005%≤B≤0.005%.

11. The method for the fabrication of a steel part as recited in claim 1, wherein the composition of the steel blank includes 0.0005%≤Ca≤0.005%.

* * * * *